US006908339B2

(12) United States Patent
Tanaka

(10) Patent No.: US 6,908,339 B2
(45) Date of Patent: Jun. 21, 2005

(54) CONNECTOR HAVING A SIMPLE STRUCTURE ASSURING A STABLE MOUNTING OPERATION

(75) Inventor: Yukitaka Tanaka, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 10/912,803

(22) Filed: Aug. 6, 2004

(65) Prior Publication Data

US 2005/0032426 A1 Feb. 10, 2005

(30) Foreign Application Priority Data

Aug. 7, 2003 (JP) ..... 2003-288682

(51) Int. Cl.[7] ..... H01R 13/648
(52) U.S. Cl. ..... 439/607; 439/564
(58) Field of Search ..... 439/607, 79, 564, 439/567

(56) References Cited

U.S. PATENT DOCUMENTS 5,637,014 A * 6/1997 Sukegawa et al. ..... 439/607
5,718,605 A * 2/1998 Morikawa et al. ..... 439/607
6,234,837 B1 * 5/2001 Wu ..... 439/564
6,299,461 B1 * 10/2001 Zhu et al. ..... 439/607
6,554,642 B1 4/2003 Xiang et al.
6,733,339 B2 * 5/2004 Casey ..... 439/607
6,786,770 B1 * 9/2004 Huang ..... 439/607

* cited by examiner

*Primary Examiner*—Tho D. Ta
(74) *Attorney, Agent, or Firm*—Frishauf, Holtz, Goodman & Chick, P.C.

(57) ABSTRACT

A connector to be mounted to a board includes a contact having an angled portion, a housing having a fitting portion and fixedly holding the contact, and a conductive shell. The shell includes a front shell covering the fitting portion and a back shell covering the angled portion. The front shell has a terminal to be connected to the board and a fixing portion provided with an insertion hole allowing a screw to be inserted therethrough. The back shell has a terminal to be connected to the board and a fixed portion faced to the fixing portion. The fixed portion has a tap portion. The front and the back shells are fixed to the housing by screwing the screw through the insertion hole into the tap portion.

5 Claims, 8 Drawing Sheets

CONNECTOR HAVING A SIMPLE STRUCTURE ASSURING A STABLE MOUNTING OPERATION

This application claims priority to prior Japanese patent application JP 2003-288682, the disclosure of which is incorporated herein by reference.

BACKGROUND OF THE INVENTION

This invention relates to a connector having an electromagnetic shielding function and adapted to be mounted on a board such as a printed circuit board known in the art.

A connector of the type is disclosed, for example, in U.S. Pat. No. 6,554,642 as an electrical connector. The electrical connector comprises an insulator housing surrounded by a back shell and a front shell which are made of conductive members, respectively. The back shell and the front shell are electrically connected to each other through mechanical contact at their portions. The front shell has a tap portion fixed via a screw to a casing panel or a chassis panel of an electric or electronic apparatus.

When the electrical connector is mounted to a circuit board, the electrical connector is electrically connected to the circuit board by the use of a grounding member. However, since the grounding member is required, the number of components is increased and assembling requires a lot of time and labor (a number of steps), resulting in an increase in cost.

When the electrical connector is attached to the panel, the front shell is pulled towards the chassis panel and applied with a load. If a connecting strength between the front shell and the housing or a connecting strength between the front shell and the back shell is weak, the front shell may possibly be released.

Further, the back shell is not terminated at the circuit board but a separate component connected to the front shell is terminated at the circuit board. Therefore, a grounding signal is difficult to flow towards the back shell. Further, the grounding signal flowing from the front shell may be reflected at an end portion of the back shell. In addition, if the contact between the front shell and the separate component is insufficient, an electrically stable loop can not be obtained. In this event, reflection may also occur at an end portion of the front shell. Such reflection causes electromagnetic interference to induce a noise.

SUMMARY OF THE INVENTION

It is therefore an object of the present invention to provide a connector having a simple structure assuring a stable operation of mounting the connector to a circuit board and a stable operation of attaching the connector to a chassis panel.

It is another object of the present invention to provide a connector which is enhanced in connecting strength between a front shall and a back shell.

It is still another object of this invention to provide a connector sufficiently enhanced in shielding function.

Other objects of the present invention will become clear as the description proceeds.

According to an aspect of the present invention, there is provided a connector to be mounted to a board, the connector comprising a contact having an angled portion, a housing having a fitting portion and fixedly holding the contact, and a shell being conductive, the shell including a front shell covering the fitting portion and a back shell covering the angled portion, the front shell having a terminal to be connected to the board and a fixing portion provided with an insertion hole allowing a screw to be inserted therethrough, the back shell having a terminal to be connected to the board and a fixed portion faced to the fixing portion, the fixed portion having a tap portion, the front and the back shells being fixed to the housing by screwing the screw through the insertion hole into the tap portion.

DESCRIPTION OF THE PREFERRED EMBODIMENT

Figure 1A:
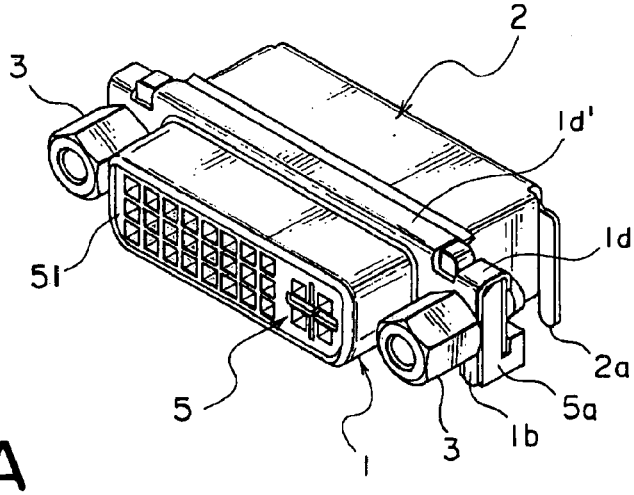
FIG. 1A is a front, top, and right side perspective view of a connector according to an embodiment of the present invention.
Figure 1B:
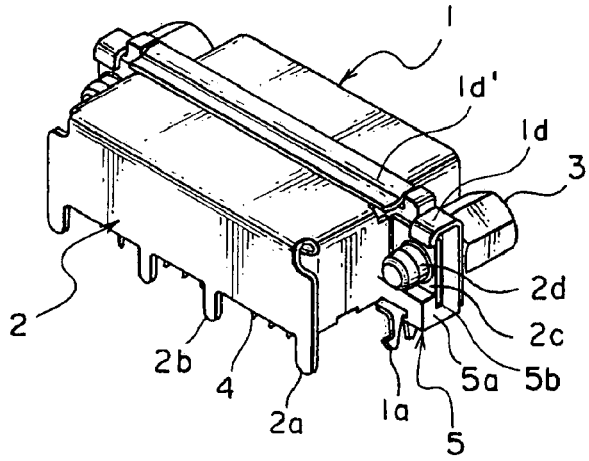
FIG. 1B is a rear, top, and left side perspective view of the connector in FIG. 1A.
Figure 1C:
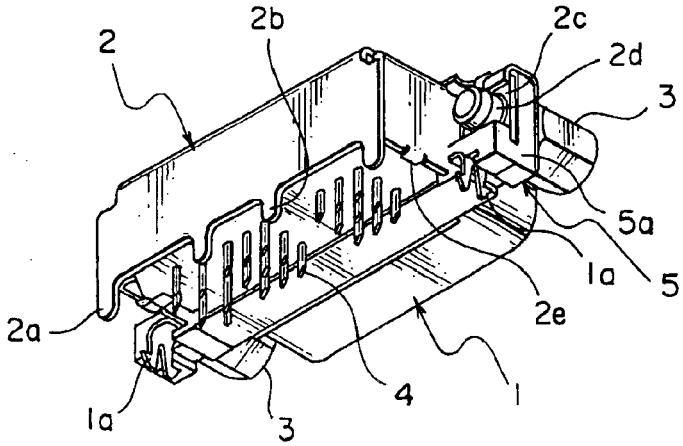
FIG. 1C is a rear, bottom, and left side perspective view of the connector in FIG. 1A.

Referring to FIGS. 1A to 1C, description will be made of a whole of a connector according to an embodiment of this invention.

Figure 5B:
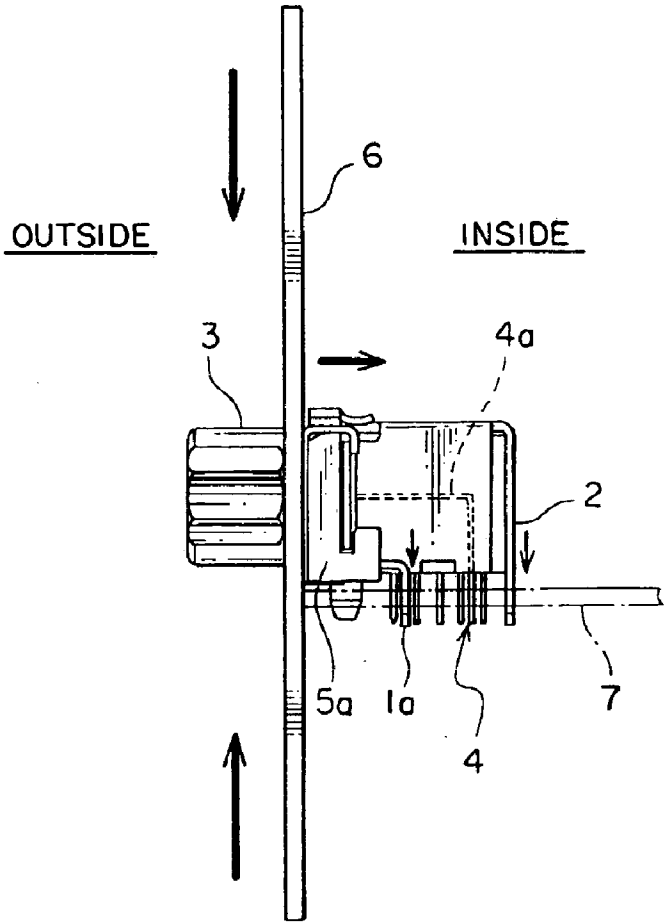
FIG. 5B is a side view of the connector when it is attached to the chassis panel with an electric current flow similarly depicted by thick solid lines.
Figure 5A:
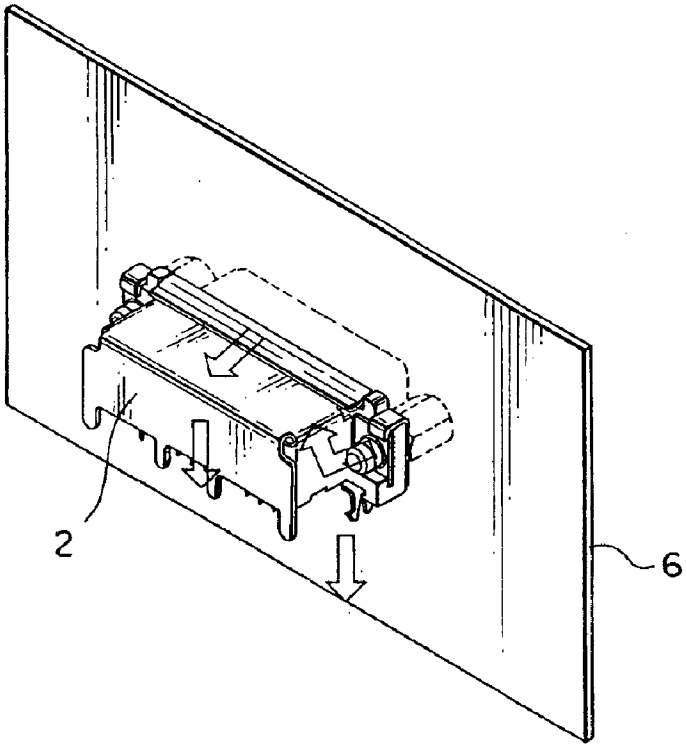
FIG. 5A is an enlarged perspective view corresponding to FIG. 4B with an electric current flow depicted by white arrows.

The connector illustrated in the figures comprises a plurality of conductive contacts 4 and an insulating housing 5 fixedly holding the contacts 4. The housing 5 has a fitting portion 51 covered by a conductive front shell 1. Each of the contacts 4 has an angled portion 4*a* covered with a conductive back shell 2, as also illustrated in FIG. 5B. The connector is mounted to a board such as a printed circuit board 7 as shown in FIG. 5B.

Figure 2A:
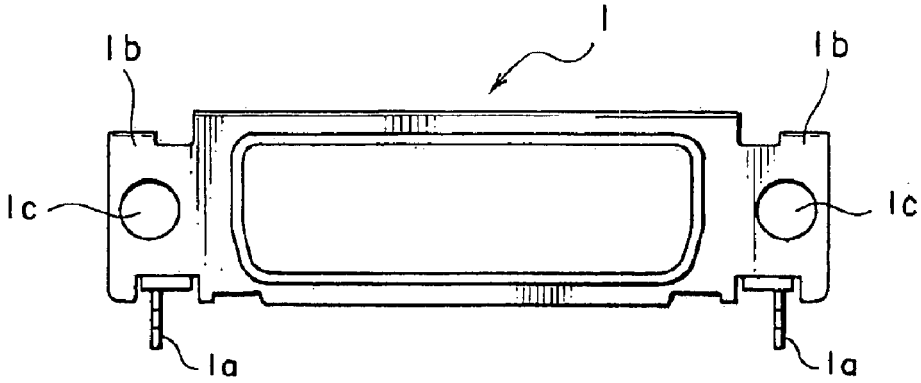
FIG. 2A is a front view of a front shell contained in the connector illustrated in FIGS. 1A to 1C.
Figure 2B:
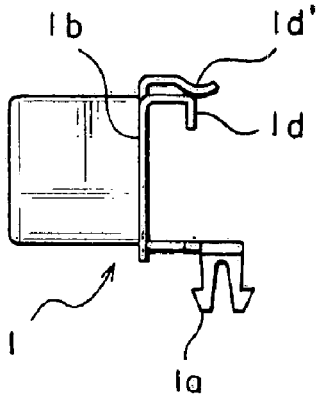
FIG. 2B is a side view of the front shell in FIG. 2A.
Figure 2C:
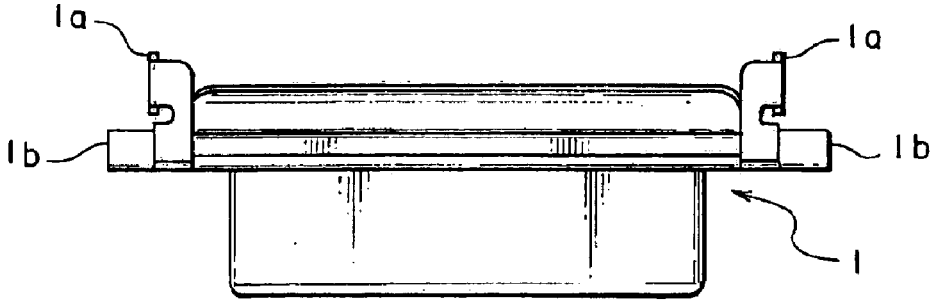
FIG. 2C is a plan view of the front shell in FIG. 2A.

Referring to FIGS. 2A to 2C in addition, the front shell 1 has a pair of hooked terminals 1*a* and a pair of fixing portions 1*b* integrally formed on opposite sides thereof. The hooked terminals 1*a* are adapted to be connected to the circuit board 7. Each of the fixing portions 1*b* has an insertion hole 1*c* for inserting a screw 3. The front shell 1 is provided with a pair of lower contacting pieces 1*d* at the opposite sides and with an upper contacting piece 1*d*' between the opposite sides. The lower and the upper contacting pieces 1*d* and 1*d*' are integrally formed on an upper part of the front shell 1 to be elastically connected to the back shell 2. A combination of the contacting pieces 1*d* and 1*d*' will be called a contacting portion. Each of the hooked terminals 1*a* of the front shell 1 has a hook portion integrally formed and adapted to be engaged with the circuit board 7.

Referring to FIGS. 3A–3F, the back shell 2 has a pair of wide terminals 2*a* formed on opposite sides thereof to be connected to the circuit board 7, and a pair of relatively narrow terminals 2*b* disposed between the terminals 2*a*. The back shell 2 is further provided with a pair of fixed portions 2*c* formed on its opposite sides and having tap portions to receive the screws 3 inserted and screwed therein. The back shell 2 is provided with a press-fit portion 8 having opposite surfaces to be press-contacted to the contacting pieces 1*d* and 1*d*' of the front shell 1. More particularly, the press-fit portion 8 is press fitted between the upper contacting piece 1*d*' and a group of the lower contacting pieces 1*d*. Thus, the contacting pieces 1*d* and 1*d*' are elastically contacted with the press-fit portions 8.

The housing 5 has a pair of flange portions 5*a* integrally formed on its opposite sides and clamped between the fixing portions 1*b* of the front shell 1 and the fixed portions 2*c* of the back shell 2. Each of the flange portions 5*a* has a groove 5*b* for positioning the fixed portions 2*c*. By screwing the screws 3 through the insertion holes 1*c* to the tap portions 2*d*, the front shell 1 and the back shell 2 are fixed to the housing 5.

Each of the contacting pieces 1*d* located on a relatively lower side in FIG. 2B is bent at its end so as to surround an upper end of the flange portion 5*a* and an upper end of the fixed portion 2*c*, as illustrated in FIG. 5B. As a consequence, the fixed portion 2*c* is locked to the flange portion 5*a* by the contacting portion 1*d* and the groove 5*b*. Simultaneously, the contacting piece 1*d* is contacted with the fixed portion 2*c*.

In the above-mentioned connector, the hooked terminals 1*a* of the front shell 1 and the four terminals 2*a* and 2*b* of the back shell 2 contributes to connection with the circuit board, together with the contacts 4. By the screws 3, the front shell 1 and the back shell 2 are fixed to the housing 5.

Referring to FIGS. 4A, 4B, 5A, and 5B, a casing panel or a chassis panel 6 is included in an electric or electronic apparatus and clamped between the fixing portions 1*b* of the front shell 1 and the screws 3. In order to attach the connector to the chassis panel 6, the screws 3 are screwed into the tap portions 2*d* of the back shell 2 through the insertion holes 1*c* of the front shell 1 and insertion holes (not shown) of the chassis panel 6. As a result, the chassis panel 6 is steadily clamped between the fixing portions 1*b* of the front shell 1 and the screws 3.

In this state, a part of the front shell 1, the fitting portion 51 of the housing 5 (i.e., a portion to be fitted to a mating connector), and a main body of each of the screws 3 are exposed outside the chassis panel 6. Inside the chassis panel 6, the back shell 2 covering the angled portions 4*a* of the contacts 4 in the housing 5, the terminals 2*a* and 2*b*, and the fixed portions 2*c*, the flange portions 5*a* of the housing 5, a connected portion of each contact 4, and a threaded portion of each screw 3 are disposed.

In the above-mentioned connector, the hooked terminals 1*a* contributing to connection with the circuit board 7 are integrally formed on the front shell 1. Therefore, no separate component for grounding is required so that the number of components is reduced and assembling does not require a lot of time and labor (a number of steps). This means that the connector can be produced at a low cost. Thus, cost improvement is achieved.

The chassis panel 6 is clamped between the fixing portions 1*b* of the front shell 1 and the screws 3. The back shell 2 is connected and fixed by the screws 3. The terminals (the hooked terminals 1*a* of the front shell 1 and the terminals 2*a* and 2*b* of the back shell 2) contributing to connection with the circuit board 7 are integrally formed on the front shell 1 and the back shell 2, respectively. The front shell 1 is provided with the contacting pieces 1*d* and 1*d*' formed integral therewith and adapted be elastically connected to the back shell 2. Therefore, an electric loop is formed in each of the front shell 1 and the back shell 2 so that no reflection of a grounding signal is caused. Thus, a whole of the connector is strongly shielded as the connector of a shield-enhanced type with a simple structure.

In order to attach the connector to the chassis panel 6, the screws 3 are inserted through the insertion holes 1*c* of the front shell 1 and the insertion holes of the chassis panel 6 to be fastened to the tap portions 2*d* of the back shell 2. In this manner, the chassis panel 6 is clamped between the fixing portions 1*b* of the front shell 1 and the screws 3. As a consequence, the back shell 2 is applied with a load so that the back shell 2 is drawn towards the chassis panel 6. Simultaneously, the front shell 1 and the housing 5 are also applied with a load towards the chassis panel 6. Therefore, the connecting strength between the front shell 1 and the housing 5 as well as the connecting strength between the front shell 1 and the back shell are stably maintained so that the mechanical strength is remarkably improved. In addition, the front shell 1 is also applied with a load towards the chassis panel 6. Therefore, tight contact between the chassis panel 6 and the front shell 1 is improved so that mounting and fixing operations can stably be carried out.

The number and the shape of the terminals for grounding the front shell 1 and the back shell 2 may be appropriately modified as desired.

Figure 6A:
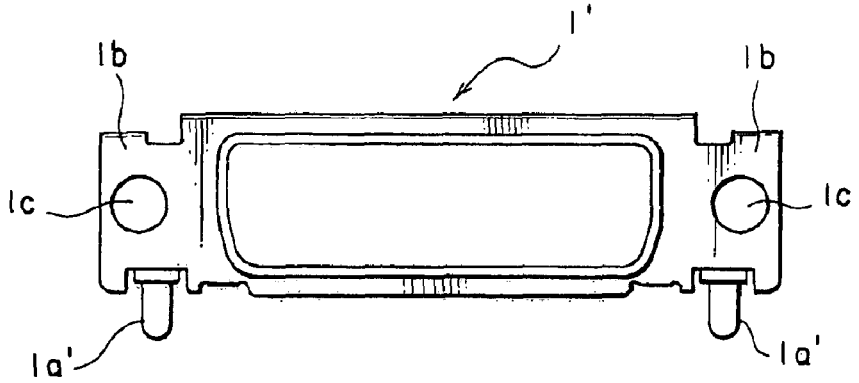
FIG. 6A is a front view of a modification of the front shell.
Figure 6B:
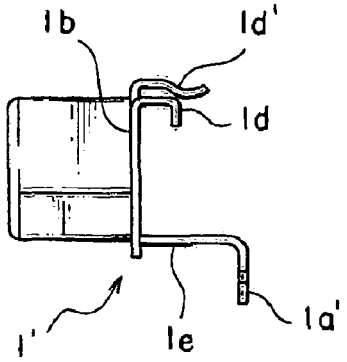
FIG. 6B is a side view of the modification of the front shell.
Figure 6C:
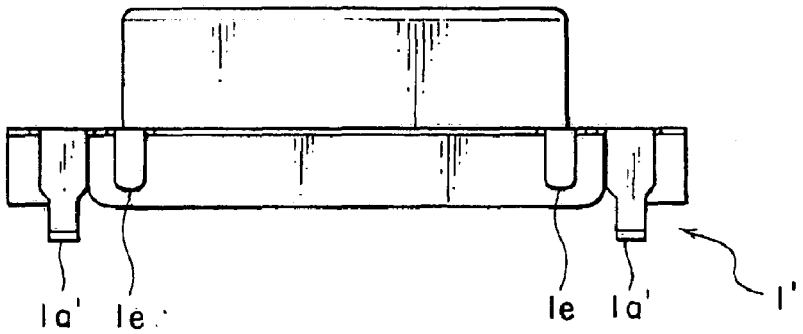
FIG. 6C is a bottom view of the modification of the front shell.

Referring to FIGS. 6A through 6C, a modification of the front shell 1 will be described. Similar parts are designated by like reference numerals and will not be described.

The front shell 1' in FIGS. 6A through 6C has a pair of terminals 1*a*' having a generally L-shaped section, instead of the hooked terminals 1*a* of the front shell 1 in FIGS. 2A through 2C. The front shell 1' having the above-mentioned structure also has the insertion holes 1*c* formed in the fixing portions 1*b*. Therefore, the front shell 1' can be connected and fixed to the back shell 2 or 2' by fastening the screws 3 to the tap portions 2*d* of the fixed portions 2*c* or 2*c*'. Thus, the connector using the front shell 1' in FIGS. 6A through 6C has a function and an effect equivalent to those of the connector in FIGS. 1A through 1C.

Figure 7A:
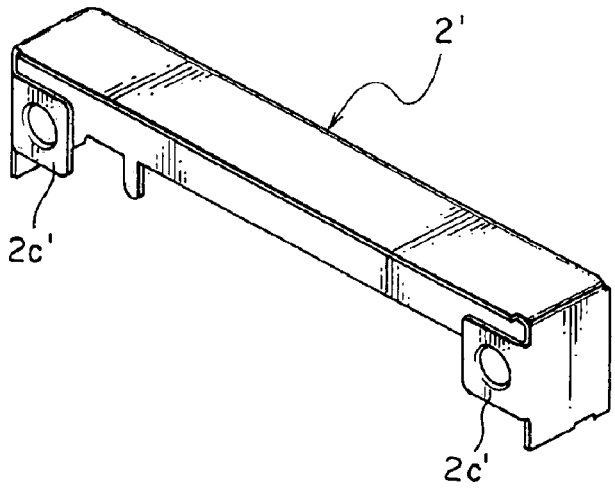
FIG. 7A is a front, top, and right side perspective view of a modification of the back shell.
Figure 7B:
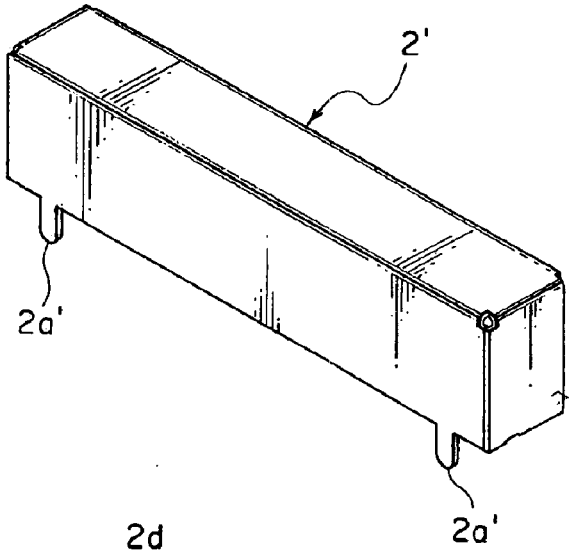
FIG. 7B is a rear, top, and left side perspective view of the modification of the back shell.
Figure 7C:
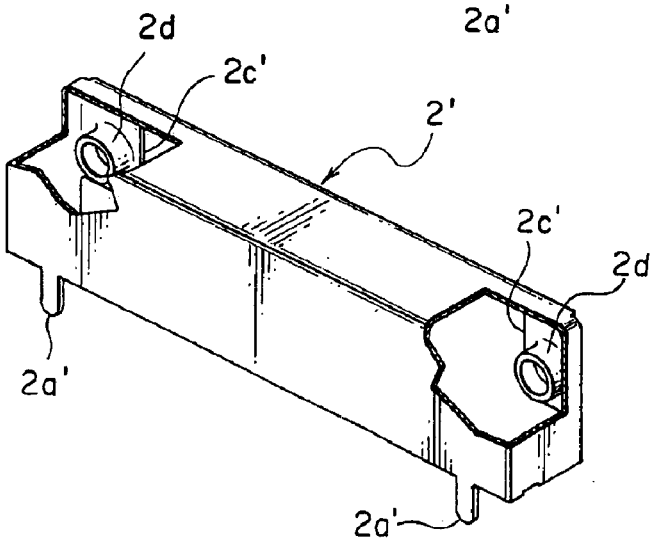
FIG. 7C is a view similar to FIG. 7B with a part cut away.

Referring to FIGS. 7A through 7C, a modification of the back shell 2 will be described. Similar parts are designated by like reference numerals and will not be described.

The back shell 2' illustrated in FIGS. 7A through 7C is designed to be greater in size than the back shell 2 in FIGS. 3A through 3F in a left-to-right direction as seen from a front side. Further, the back shell 2' has fixed portions 2*c*' folded inside and a pair of terminals 2*a*' formed at its lower end of opposite sides thereof. The back shell 2' of the above-mentioned structure also has the tap portions 2*d* in the fixed portions 2*c*'. Therefore, by connecting and fixing the back shell 2' to the front shell 1 by the use of the screws 3, the connector has a function and an effect equivalent to those of the connector in FIGS. 1A through 1C.

Figure 3A:
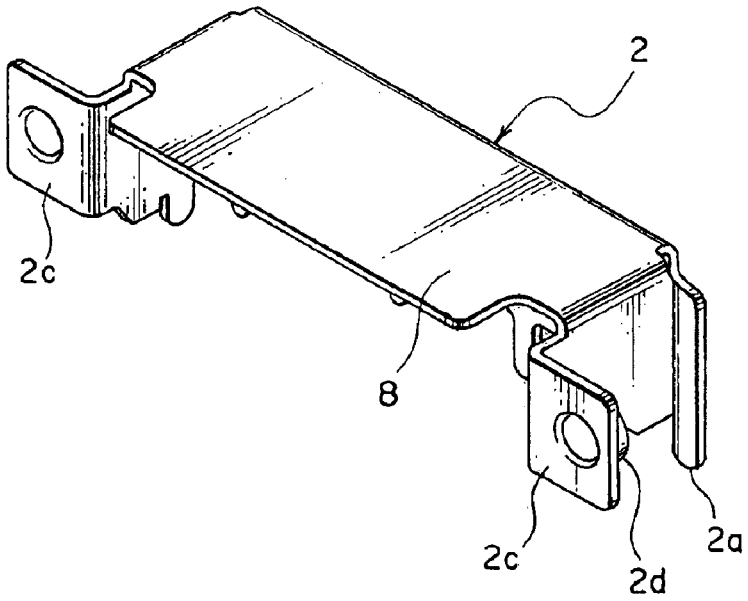
FIG. 3A is a front, top, and right side perspective view of a back shell contained in the connector illustrated in FIGS. 1A to 1C.
Figure 3B:
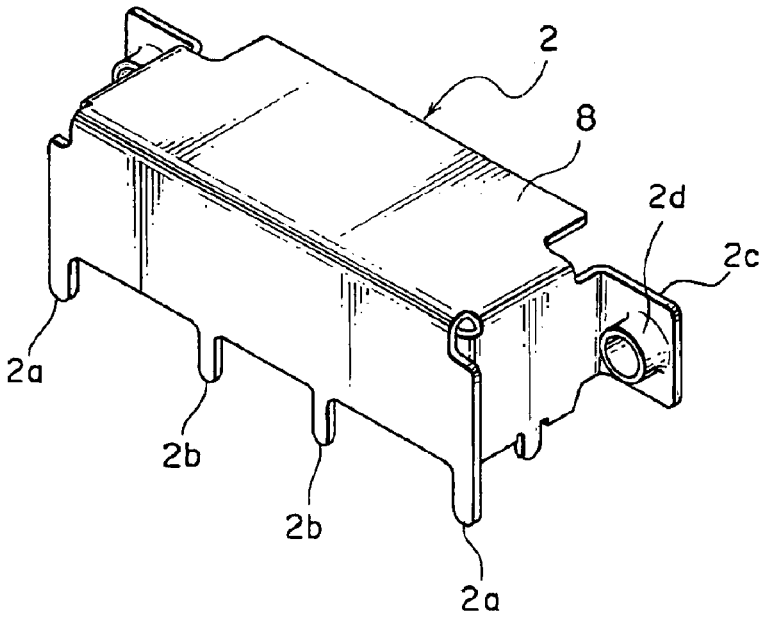
FIG. 3B is a rear, top, and left side perspective view of the back shell in FIG. 3A.
Figure 3C:
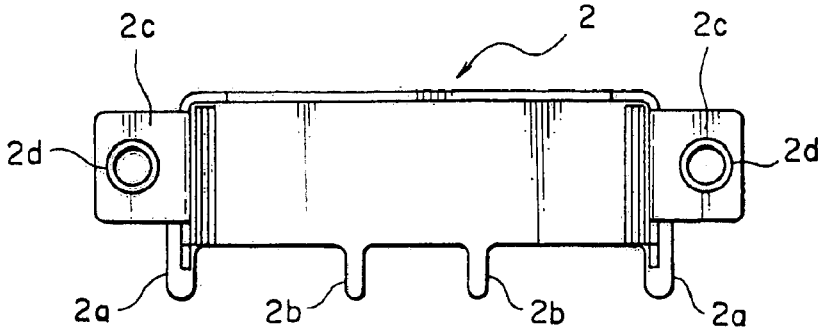
FIG. 3C is a front view of the back shell in FIG. 3A.
Figure 3D:
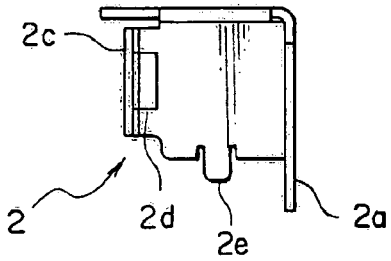
FIG. 3D is a right side view of the back shell in FIG. 3A.
Figure 3E:
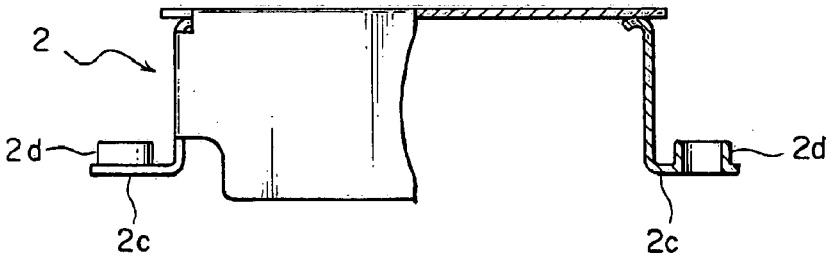
FIG. 3E is a partially cut-away plan view of the back shell in FIG. 3A.
Figure 3F:
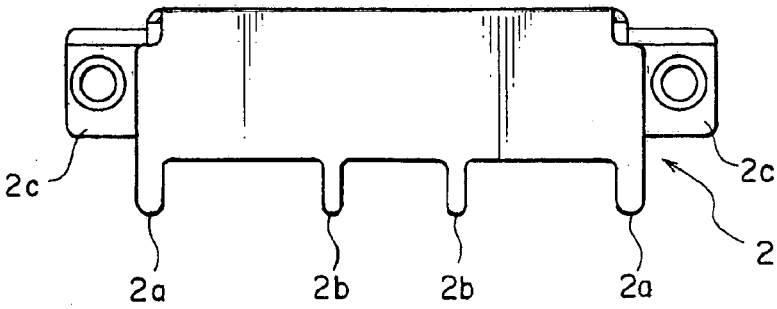
FIG. 3F is a rear view of he back shell in FIG. 3A.
Figure 4A:
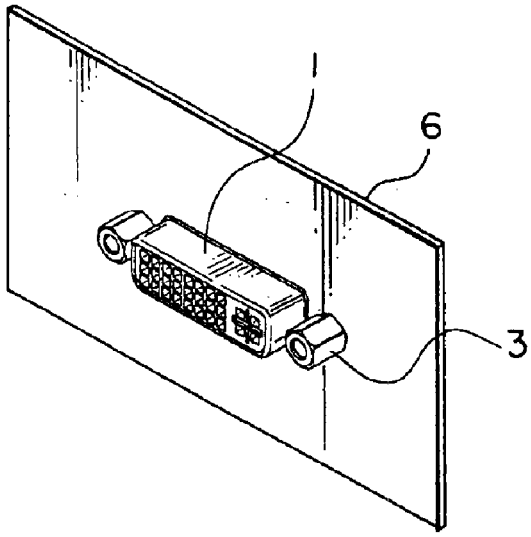
FIG. 4A is a perspective view of the connector as seen from a front side when the connector is attached to a chassis panel.
Figure 4B:
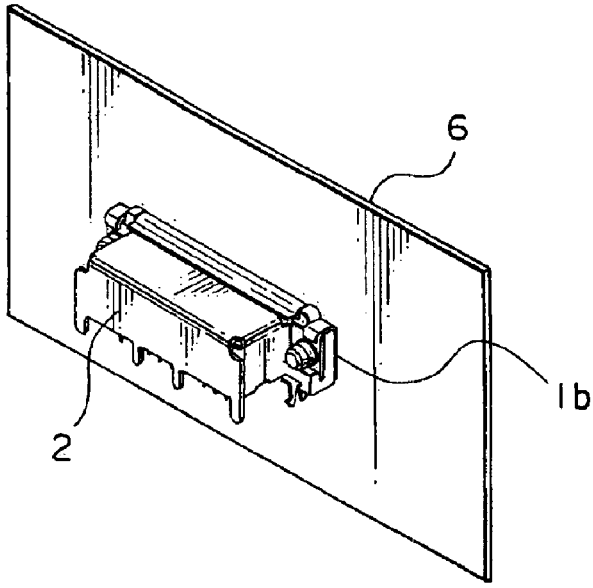
FIG. 4B is a perspective view similar to FIG. 4A but as seen from a rear side.

It will readily be understood that this invention is not restricted to the connector in the foregoing embodiment. For example, the housing 5 may not have the flange portions 5*a* so that the fixing portions 1*b* of the front shell 1 and the fixed portions 2*c* of the back shell 2 are directly contacted with each other. In this case, it is preferable that the contacting piece formed on at least one of the fixing portion 1*b* and the fixed portion 2*c* is changed in shape so that the fixing portion 1*b* and the fixed portion 2*c* are elastically contacted with each other. In case where a whole of the connector has a large size and a large mass (weight), the structure of the connector, including the number of the screws 3, may appropriately be changed. Further, in order to reliably fix the front shell 1 or 1' and the back shell 2 or 2', for example, a fixing member 2*e* may be formed at a predetermined position of the back shell 2 as illustrated in FIG. 3D. In addition, a fixing member 1*e* may be formed at a predetermined position of the front shell 1' as illustrated in FIG. 6C so that the front shell and the back shell are fixed to each other by caulking the fixing members 1*e* and 2*e* of one of the shells to the other.

The connector of this invention is sufficiently enhanced in connecting strength between the front shell and the back shell and in shielding function and has a simple structure assuring a stable operation in mounting the connector to the circuit board and in attaching the connector to the chassis panel. Thus, the connector of this invention is particularly suitable as a high-frequency connector, such as a DVI connector, an infiniband connector, and a PCI connector, which requires suppression of noise due to electromagnetic interference (EMI protection) and an excellent shielding function.

While this invention has thus far been described in conjunction with the preferred embodiment thereof, it will be readily possible for those skilled in the art to put this invention into practice in various other manners.

What is claimed is:

1. A connector to be mounted to a board, said connector comprising:

a contact having an angled portion;

a housing which comprises a fitting portion and which fixedly holds said contact; and a conductive shell including a front shell covering said fitting portion and a back shell covering said angled portion;

wherein said front shell comprises at least one terminal to be connected to said board, and at least one fixing portion having an insertion hole for a screw, and wherein said back shell comprises at least one terminal to be connected to said board, and at least one fixed portion which faces said at least one fixing portion;

wherein said at least one fixed portion comprises a tap portion, and said front and said back shells are fixed to said housing by said screw, which is screwed through said insertion hole into said tap portion;

wherein said front shell further comprises a contacting portion which connects said front shell and said back shell and which comprises two groups of contacting pieces, and wherein at least one of the contacting pieces is engaged with a corresponding at least one said fixed portion; and wherein said back shell further comprises a press-fit portion which is press-fitted between said two groups of contacting pieces.

2. The connector according to claim 1, wherein said housing further comprises a flange portion which is clamped between said fixing portion and said fixed portion.

3. The connector according to claim 1, wherein said terminal of the front shell comprises a hook portion to be engaged with said board.

4. The connector according to claim 1, wherein said front shell further comprises a fixing member which clamps said housing in cooperation with said contacting portion.

5. The connector according to claim 1, wherein said back shell further comprises a fixing member to be engaged with said housing.

* * * * *